US005213042A

United States Patent [19]

Larios

[11] Patent Number: 5,213,042

[45] Date of Patent: May 25, 1993

[54] PRINTING PROCESS AND APPARATUS

[75] Inventor: Frank N. Larios, Loomis, Calif.

[73] Assignee: The NuVentures Foundation, Denver, Colo.

[21] Appl. No.: 842,039

[22] Filed: Feb. 25, 1992

[51] Int. Cl.[5] ..... B41F 1/18

[52] U.S. Cl. ..... 101/450.1; 101/136; 101/142; 101/489; 101/491

[58] Field of Search ..... 101/136, 137, 138, 141, 101/142, 143, 181, 183, 450.1, 489, 490, 491; 118/46, 621, 624; 427/197, 202, 14.1, 25

[56] References Cited

U.S. PATENT DOCUMENTS

| | | | |
|---|---|---|---|
| 2,573,881 | 11/1951 | Walkup et al. | 101/426 |
| 3,049,077 | 8/1962 | Damm, Jr. | 101/211 |
| 3,355,743 | 11/1967 | Capps | 346/74 |
| 3,380,436 | 4/1968 | Williamson et al. | 118/46 |
| 3,448,687 | 6/1969 | Pittenger et al. | 101/426 |
| 3,526,191 | 9/1970 | Silverberg et al. | 101/426 |
| 3,530,794 | 9/1970 | Ritzerfeld | 101/216 |
| 3,661,081 | 5/1972 | Wright | 101/489 |
| 3,954,331 | 5/1976 | Smith | 118/637 |
| 4,113,895 | 9/1978 | Watt et al. | 427/44 |
| 4,282,303 | 8/1981 | Bergen | 430/120 |
| 4,470,350 | 9/1984 | Wright | 101/426 |
| 4,632,537 | 12/1986 | Imai | 118/624 |
| 4,805,531 | 2/1989 | Sarda | 101/488 |
| 5,016,529 | 5/1991 | Jahn | 101/183 |

*Primary Examiner*—Edgar S. Burr
*Assistant Examiner*—Ren Yan
*Attorney, Agent, or Firm*—Browning, Bushman Anderson & Brookhart

[57] ABSTRACT

An apparatus and process in which a carrier image is applied to paper and ink is attracted to the carrier to form a printed image. The process is readily adaptable to the conventional printing methods including offset lithography. An apparatus for carrying out the process of the invention may be retrofitted onto a lithographic printer.

10 Claims, 4 Drawing Sheets

PRINTING PROCESS AND APPARATUS

BACKGROUND OF THE INVENTION

1. Field of the Invention

The present invention relates generally to an improved process and apparatus for printing. More specifically, the present invention is directed to a new, novel, process/apparatus for application of a carrier onto paper and attraction of ink to the carrier to form a printed image.

2. Description of the Background

Printing is one of the most important means of mass communication along with television and radio. Printed matter is used in many areas of society including business, recreation, and education. The U.S. printing industry employs over a million people and is among America's fastest growing industries with sales in 1989 of approximately $73 billion.

In most commercial printing, one or more of three basic printing processes are normally involved: (1) offset lithography, (2) relief printing, or (3) gravure printing. Relief printing and gravure printing generally use, respectively, associated raised and sunken printing surfaces. Offset lithography printing normally uses a substantially even printing surface. Of these three processes, offset lithography is the most commonly used printing process. This process may be used to print books, cartons, labels, magazines, stationery, metal containers and many other items.

The operation of modern lithographic printers is based, in general terms, on the principle that oil (grease) and water do not mix. The printing plate typically has image areas to which the printing ink sticks and water is repelled. Correspondingly, the plate also has non-image areas which repel ink and which attract water. The printing plate is normally clamped to a plate cylinder to form a rotary press. As the plate cylinder rotates, the plate is wet by water rollers so the non-image or non-printing areas will repel the printing ink. The plate cylinder then rolls against ink rollers which place the ink on the image or printing areas. The plate cylinder, now containing printers ink on the image areas, typically transfers or offsets this image by rolling against a blanket cylinder which often has a rubber outer coating. A sheet or web of paper may then be fed between the blanket cylinder and an impression cylinder for transferring or offsetting the image onto the paper. The paper is then normally stacked for drying. This process allows for high speed printing. A printing press may print eleven miles worth of paper in an hour and have web speeds of about 300 meters per minute.

Some offset presses, with only a single plate cylinder, print only black or any other single color. Other presses may have four plate cylinders—one each to print red, yellow, blue and black ink. In multi-color printing, the colors of all the plates combine, in a manner well known in the art, to form the tones of the color picture. The black ink roller is generally included to add sharpness to the picture even though, theoretically, the black color may be formed by a combination of the other colors.

Although it is a well established art, the offset printing process has a number of general problems. For instance, this process requires a large number of ink rollers to move the ink in liquid form from an ink fountain to the plate cylinder. A large number of ink rollers is needed in order to maintain an even distribution of color density over the plate cylinder. To complicate matters, pre-mixed ink purchased from manufacturers sometimes has variations in thickness or density and may also have ink pigment variations. The problem of preventing variations in color density as the copies are checked or proofed during a printing job is largely accomplished by making adjustments to the ink flow through the large number of ink rollers. This is a difficult and sometimes stressful job which normally requires trained and experienced personnel. A lengthy, ongoing learning cycle is normally required to become a skillful pressman.

After each color application, roller washing is required and the press must be shutdown during this time. This limits the output or efficiency of the press and thereby results in lower earnings per machine. The use of roller cleaners, which may contain various solvents, shortens the life span of the rollers. These cleaners typically create fumes which may not be healthful to breathe.

The ink drying process, which may take up to 24 hours, may require special paper stacking techniques which will often involve using powders to prevent the sheets from offsetting or smearing into each other. The types of paper, drying additives, and color densities used in the printing job will affect the drying time.

Liquid ink, solvent fumes, drying additives, and spray powder dust are among the chemicals to which printing employees may be regularly exposed. This exposure creates a potential health risk to these employees. As well, disposal of these items can create environmental problems. Such disposal may require governmental permits. The long term trend of environmental legislation and regulation is toward ever-increasing control over emissions. In some cases, B.A.C.T. (Best Available Control Technology) standards must be complied with to obtain a permit for producing emissions. Monetary penalties can be required for non-compliance with environmental regulations. There is also a significant waste, in conventional printing processes, of paper, ink, washing solutions, and time due to these typical problems encountered in operating printing presses.

Consequently a need exists for improvements in printing processes to increase the efficiency of printing presses, decrease operational complexity, reduce the production of waste products, and improve the working environment. Since existing printing presses may be quite expensive and represent a substantial capital expense, any apparatus or process which would alleviate or solve the above enumerated problems should be readily adaptable to conventional printing methods and/or retrofitable to existing printing presses. Of course, any apparatus or process which would solve these problems must also allow for the same high quality and high speed printing that is presently available with conventional printing processes.

Those skilled in the art have long sought and will appreciate the novel features of the present invention which solves these problems.

SUMMARY OF THE INVENTION

The present invention is directed to an improved process for printing by application of a carrier to the target element (typically paper) and attraction of ink to the carrier. A carrier is meant as a general term of an attractant substance, such as varnish in a preferred embodiment, which could be used in the process of this invention due to qualities of being mixable with ink pigments and suitable for printing, using, for instance, an offset printing method, onto a target element such as paper in the form of an image prior to the addition of ink pigments. The preferred embodiment apparatus is readily adaptable or retrofitable to conventional presses by adding additional rollers and/or roller frames to the existing press. In a preferred embodiment, a carrier such as varnish is applied to the plate roller, using conventional rollers. The varnish is used in the place of conventional printers ink. Water is applied to the plate roller in a standard manner to keep the varnish off of the non-image areas of the plate. A varnish carrier image may then be transferred to paper. The varnish image is then passed between an inking cylinder and an attraction roller where, in a preferred embodiment, dry ink is attracted electrostatically or by a differential voltage onto the varnish carrier image to form a high quality printed image. The color intensity can be readily controlled by adjusting the differential attraction voltages involved. Proofing and color adjustment time is thereby greatly reduced. Operation of the press is much less difficult. In fact, for maintaining precise color control even for very large jobs, the electronic color intensity regulation is readily and inexpensively adaptable for computer control using optical scanners. The inking cylinder is fed via ink cartridges which hold, in a preferred embodiment, dry ink. A dry ink bottle may be used to replenish the store of ink in the cartridge so that the replenishment of ink requires only changing out the bottle. In a preferred embodiment, the ink cartridge includes an agitator roller and a cartridge roller to apply an even and adjustable coating of dry ink to the inking cylinder. The ink cartridge roller surface, inking cylinder surface, and attraction roller surface will typically be held at designated relative voltages to attract ink to the varnish carrier. Drying/pressure rollers may be used to apply controlled pressure for binding the ink particles to the varnish carrier.

Since a varnish carrier is used on the printing rollers instead of colored ink, the need for cleaning rollers is greatly reduced and no washing is required when changing colors. Cleaning time may be reduced by as much as 90%. This reduction in cleaning time will increase printing press and labor efficiency so that a single printing press is able to provide a greater return on capital. Reduced need for cleaning also increases the production time and life of the rollers. The process allows for substantially instant drying so that stacking problems and drying powders are avoided. Up to approximately 80% of waste materials, such as paper, ink and washing solvents, may be eliminated so the environment, including the working milieu, is kept much cleaner.

With a single color printing press having only one plate roller, four inking cylinders may be used so that it is possible to obtain any single color without having to purchase mixed inks. If the press is used only to print in black, then only one inking cylinder is used. This process may be used with multi-color printers having four plate rollers by using a single color ink cartridge with each plate roller so that printing with four colors whereby all combinations of colors are possible.

The present invention represents a large step forward in printing technology by providing high speed and high quality printing while solving many problems that the printing industry has accepted for a long period of time as being unavoidable.

BRIEF DESCRIPTION OF THE DRAWINGS

Other features and intended advantages of the present invention will be readily apparent by the references to the following detailed description in connection with the accompanying drawings, wherein.

While the invention will be described in connection with the presently preferred embodiment, it will be understood that it is not intended to limit the invention to this embodiment. On the contrary, it is intended to cover all alternatives, modifications and equivalents as may be included in the spirit of the invention.

DETAILED DESCRIPTION OF THE PREFERRED EMBODIMENTS

Figure 1:
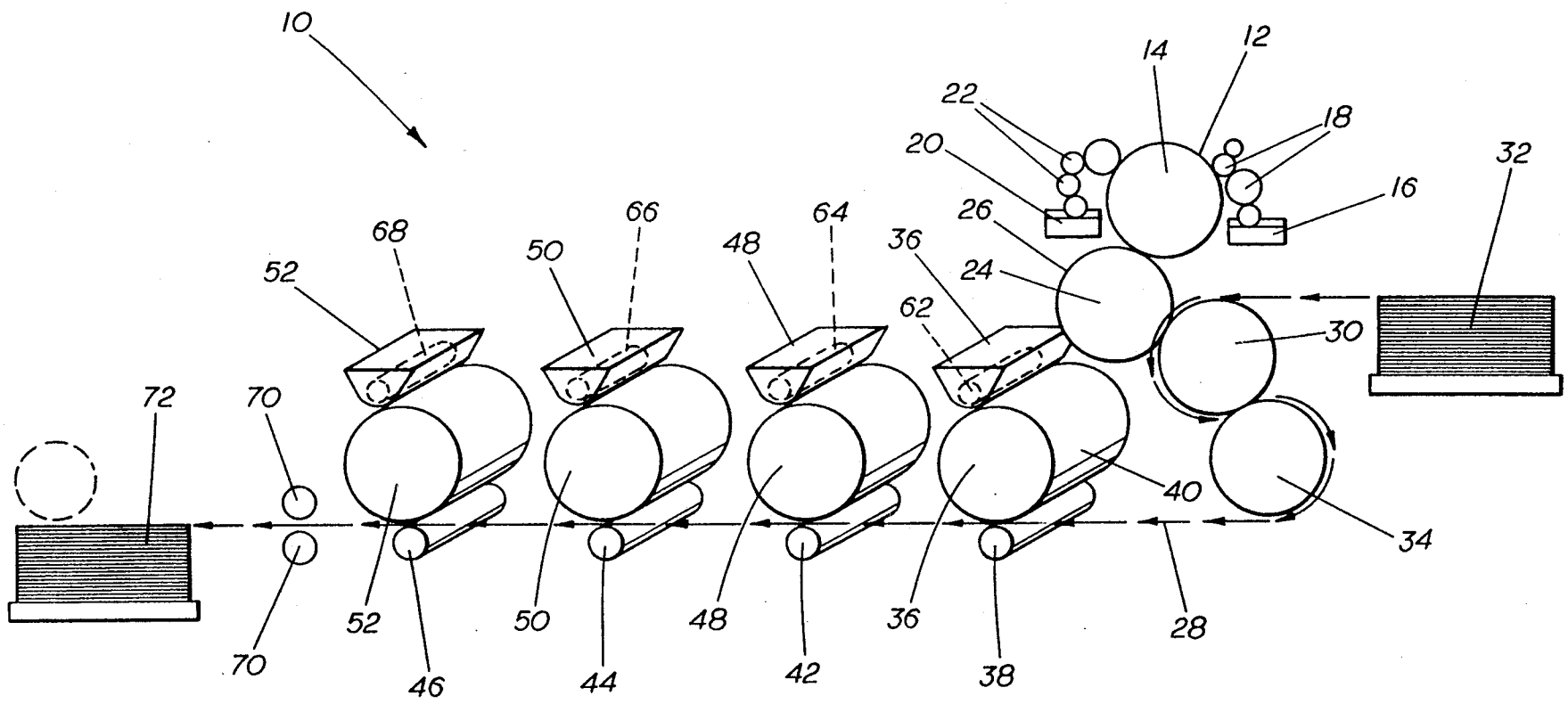
FIG. 1 is a perspective view of a single color printing apparatus which allows matching of any color of ink in accord with the present invention.

The present invention is directed to an improved process and apparatus for printing. In a preferred embodiment, this process involves application of a carrier onto paper and attraction of ink to the carrier to form a printed image. The preferred embodiment apparatus incorporates elements of a conventional lithographic printer and includes a means for attracting or injecting ink into the carrier. FIG. 1 illustrates single color printing press 10 in accord with a preferred embodiment of the present invention. A printing plate 12, often made of aluminum, is clamped to plate cylinder 14 for rotary operation. Water fountain 16 is normally kept filled with water or water solution by regulation elements not shown. Typically water fountain 16 will hold a water solution with some acid added to maintain a pH between approximately 3.5 and 4.5. Water rollers 18 are used to apply water solution to plate cylinder 14. Varnish fountain 20 supplies varnish rollers 22 with varnish carrier for application to plate cylinder 14. Printing plate 12 typically has lacquered image areas which tend to attract oleophilic and/or hydrophobic substances which may include printers ink or varnish. The non-image areas, which attract water solution, are typically formed of hydrophilic substances and may be gummed to increase their water retention properties. Varnish may be described as a solution of resin or resinous gum in spirits or oil. Varnish is conveniently used as a carrier in a preferred embodiment when this process is adapted to lithographic printing because it is relatively inexpensive and readily mixable with ink pigments to form an image. As well, it may be used in place of printers ink in a conventional lithographic printing press. Since, as will be explained hereinafter, the intensity of the final image is not dependent on the thickness of the layer of the varnish carrier, it is desirable to apply only as thick a layer of varnish to plate cylinder 14 which will allow offset of the image. A relatively thin layer of the varnish carrier reduces waste and allows for a faster drying time. Varnish rollers 22 and water rollers 18 are laterally adjustable so as to allow control of the low of both varnish and water solution to be applied against printing plate 12 on plate cylinder 14. A carrier is meant as a general term of an attractant substance which could be used in the process of this invention due to qualities of being mixable with ink pigments and suitable for printing onto a target element such as paper in the form of an image prior to the addition of ink pigments. This may include an attractant substance which could be accurately offset or transferred as by an offset printer.

Plate cylinder 14 rolls against blanket cylinder 24 and offsets or transfers the carrier image to surface 26 around blanket cylinder 24. Surface 26 may be rubber covered. Around the turn of the century, it was discovered that use of a blanket cylinder so as to form an offset printer allows for sharper image transfer. Web 28, which is marked in arrows to show the paper flow direction, is fed between blanket cylinder 24 and impression cylinder 30. In printing terminology, a web is typically used to denote a continuous sheet of paper which is fed through a printer. The varnish carrier image is transferred from surface 26 of blanket cylinder 24 to the paper of which web 28 is comprised. Paper supply 32 will typically be comprised of a roll of paper. The press may also be adapted for single sheet printing. Web 28 continues past chain delivery roller 34 to pass between inking cylinder 36 and attraction roller 38. In a preferred embodiment, inking cylinder surface 40 is comprised of a non-conductive and non-magnetic substance such as aluminum substrate, plastic, etc. Inking cylinder 36 and other inking cylinders in general are made to have approximately the same diameter as plate cylinder 14 so as to allow a more even distribution of ink than would be practical if a smaller roller size were used for inking cylinder 36. With a relatively larger diameter for inking cylinder 36, the revolutions per minute of inking cylinder 36 and other inking cylinders are reduced to allow a more even distribution of ink. Attraction rollers 38, 42, 44, and 46 have, in a preferred embodiment, a conductive surface of materials such as steel or chrome and may therefore also use insulation mounting (not shown) as necessary. Each inking cylinder 36, 48, 50, and 52 is used to apply a different colored ink to the web. By using a combination of colors such as yellow, blue, red, and black, virtually any color may be created without any need to obtain premixed ink of the particular desired color and shade. Ink cartridges 54, 56, 58, and 60 maintain a store of dry ink and supply ink to inking cylinder 36, 48, 50, and 52 respectively. The ink cartridges include respective ink cartridge rollers 62, 64, 66, and 68 each of which have a charged surface and are used to feed respective inking cylinders in a manner to described hereinafter. Drying pressure rollers 70 apply a controlled pressure to web 28 for ensuring that ink particles are bonded to the varnish and that the final image is already dry and ready to be placed in stack 72. Drying pressure rollers 70 are laterally adjustable in a direction transverse to web 28 to so that the bonding pressure applied to web 28 is adjustable. The feature of almost instant drying is a great advantage of the present invention since no special stacking or powders are necessary to avoid offsetting and smear. If the printer is to print only in black, a printer in accord with the present invention would include only a single inking cylinder since no other colors except black would be necessary. A single inking cylinder may also be used with colored or mixed ink to print in a single color. Apparatus for mixing ink may be separate or attached to the inking cylinder or ink cartridge and include means for metering ink from, in some cases, several ink bottles to provide a consistent mixture of ink.

Figure 2:
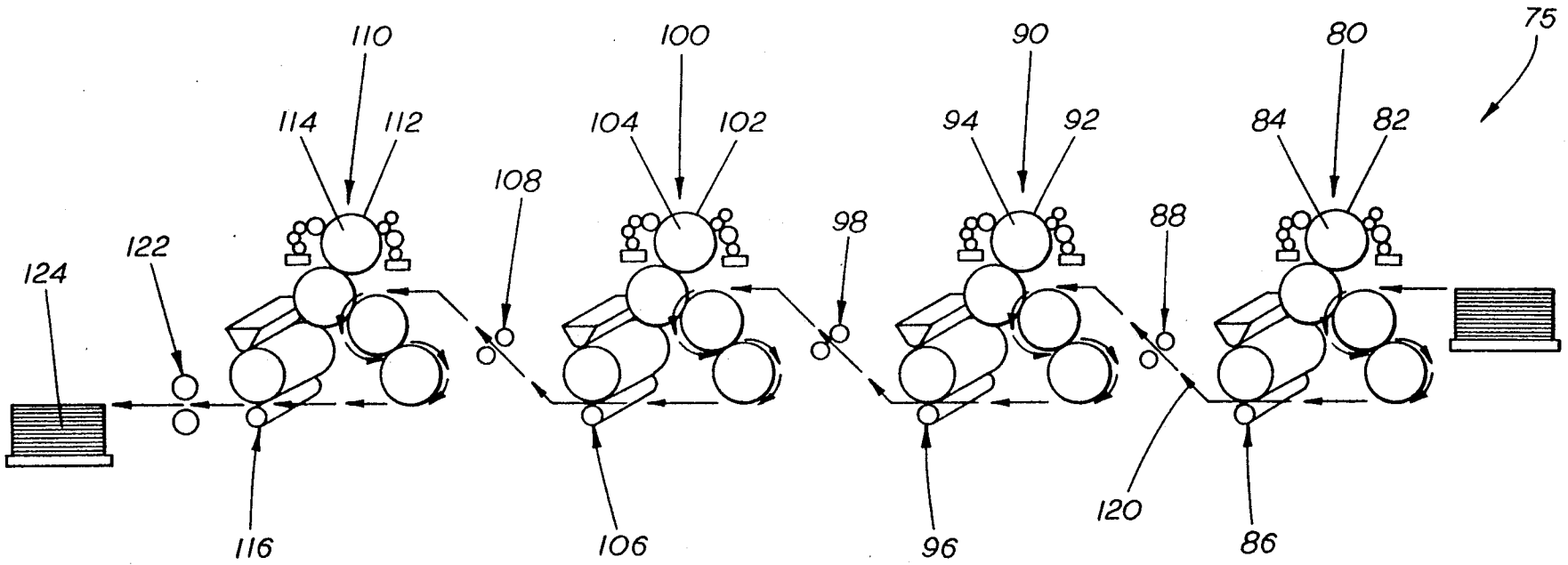
FIG. 2 is a perspective view of a multi-color printing apparatus in accord with the present invention.

FIG. 2 shows a preferred embodiment four color printing press 75. Printing color units 80, 90, 100, and 110 each print a different color. For each color, different printing plate is used. Rotary printing plates 82, 92, 102, and 112 will each produce a carrier image for the respective color ink which will be applied. A suitable carrier such as varnish is applied to each respective rotary printing plate on plate cylinders 84, 94, 104, and 114. This varnish carrier image is offset onto web 120 (which is drawn in arrows to show paper direction) for each printing color unit. Typically, the varnish image for each printing color unit will be different from each other as would be normal for a conventional four color press since the images contained on the plate cylinders will typically be different. The colors combine in a manner well known in the art to produce a range of different colors. Color inking units 86, 96, 106, and 116 apply respectively, yellow, red, blue, and black ink to each of the four varnish images on web 120 in turn. The internal components of an inking unit are discussed hereinafter with respect to FIG. 5. The final image after exiting from color inking unit 110 will be a finished multi-color print. For some purposes, the web speed of a printer in accord with the present invention will be somewhat faster than the web speed of a conventional printer. The four colors of the inks combine to produce shades of colors in a manner well known in the art. Drive rollers 88, 98, and 108 feed the web into each consecutive printing color units. Drying pressure rollers 122 apply a controlled pressure to web 128 for ensuring that ink particles are bonded to the varnish and that the final image is already dry and ready to be placed in stack 124. Drying pressure rollers 122 are laterally adjustable in a direction transverse to web 120 to so that the bonding pressure applied to web 120 is adjustable.

Figure 3:
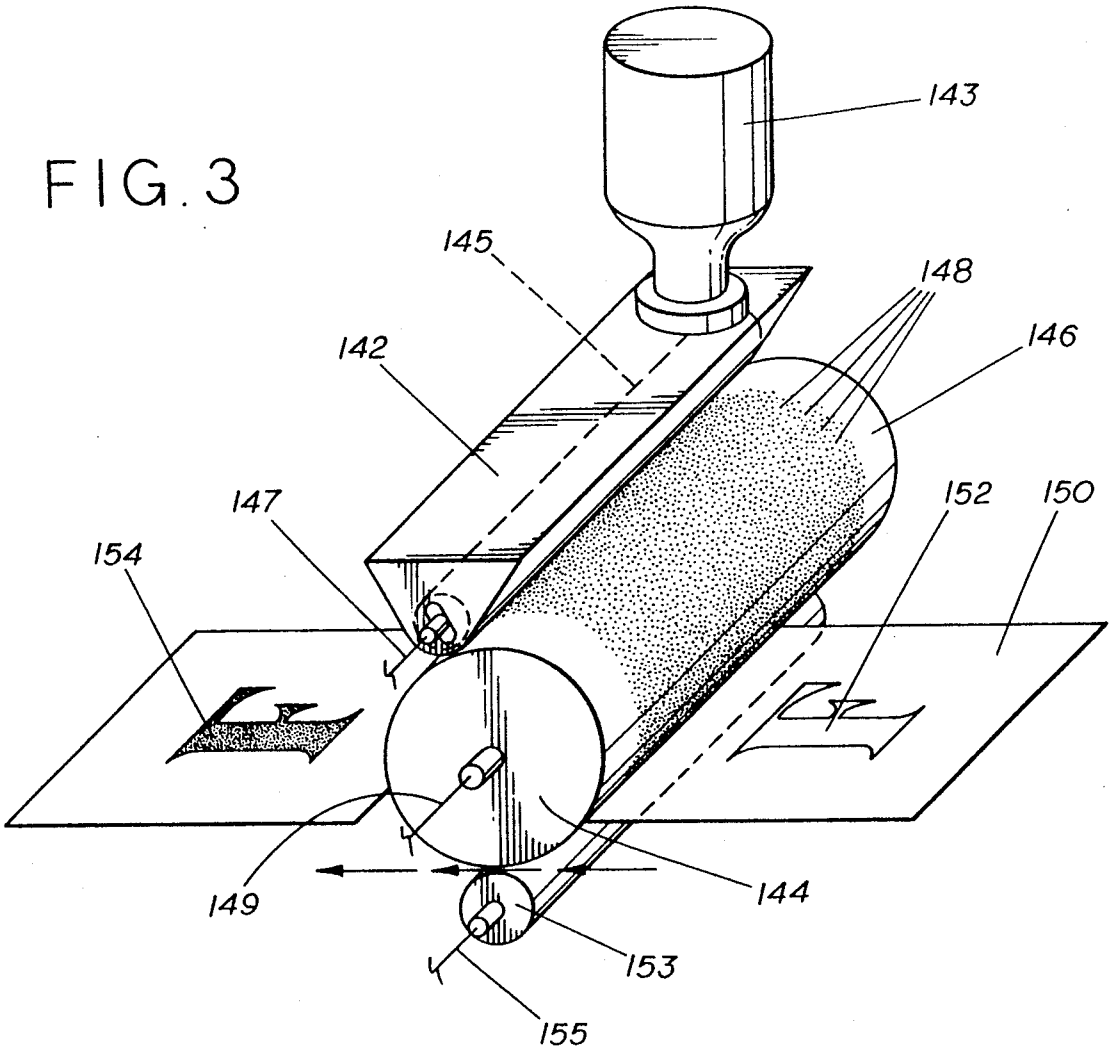
FIG. 3 is a perspective view of an inking applicator in accord with the present invention.

FIG. 3 shows an inking unit according to the present invention. Ink cartridge 142 is used to supply inking cylinder 144 with a supply of dry ink particles 148 via dry ink cartridge roller 145. A voltage is impressed on dry ink cartridge roller 145 via wire 147. Replaceable ink bottle 143 provides a convenient means of refreshing the supply of dry ink particles 148 in ink cartridge 142. In a preferred embodiment, surface 146 of inking cylinder 144 has a voltage impressed upon it which will vary from approximately 10 to 100 volts as applied by wire 149. As the voltage on surface 146 is increased, the amount of ink particles 148 attracted from ink cartridge 142 increases. When paper 150 with varnish image 152 passes between inking cylinder 144 and attraction roller 153, ink particles 148 are drawn into varnish image 152 as shown in ink plus varnish image 154. Ink particles are not drawn onto non-image areas which contain no varnish. It has been observed that a varnish image attracts ink when passed through an electrostatic copier with the lighting disconnected. It is believed that a similar principle of operation results in the transfer of ink particles 148 onto varnish plus ink image 154 as shown in a preferred embodiment of the present invention. Attraction roller 153, in this embodiment, has a constant voltage of approximately 100 volts applied to its surface via wire 155. Other voltage ranges may be used but generally differential voltages are used in the ink flow path for attraction of ink particles 148 from ink cartridge 142 onto surface 146 of inking cylinder 144 and from there to varnish image 152 on paper 150. Inking cylinder surface 146 is preferably very close but not quite in physical contact with paper 150. Paper 150 is in contact with attraction roller 153.

Figure 6:
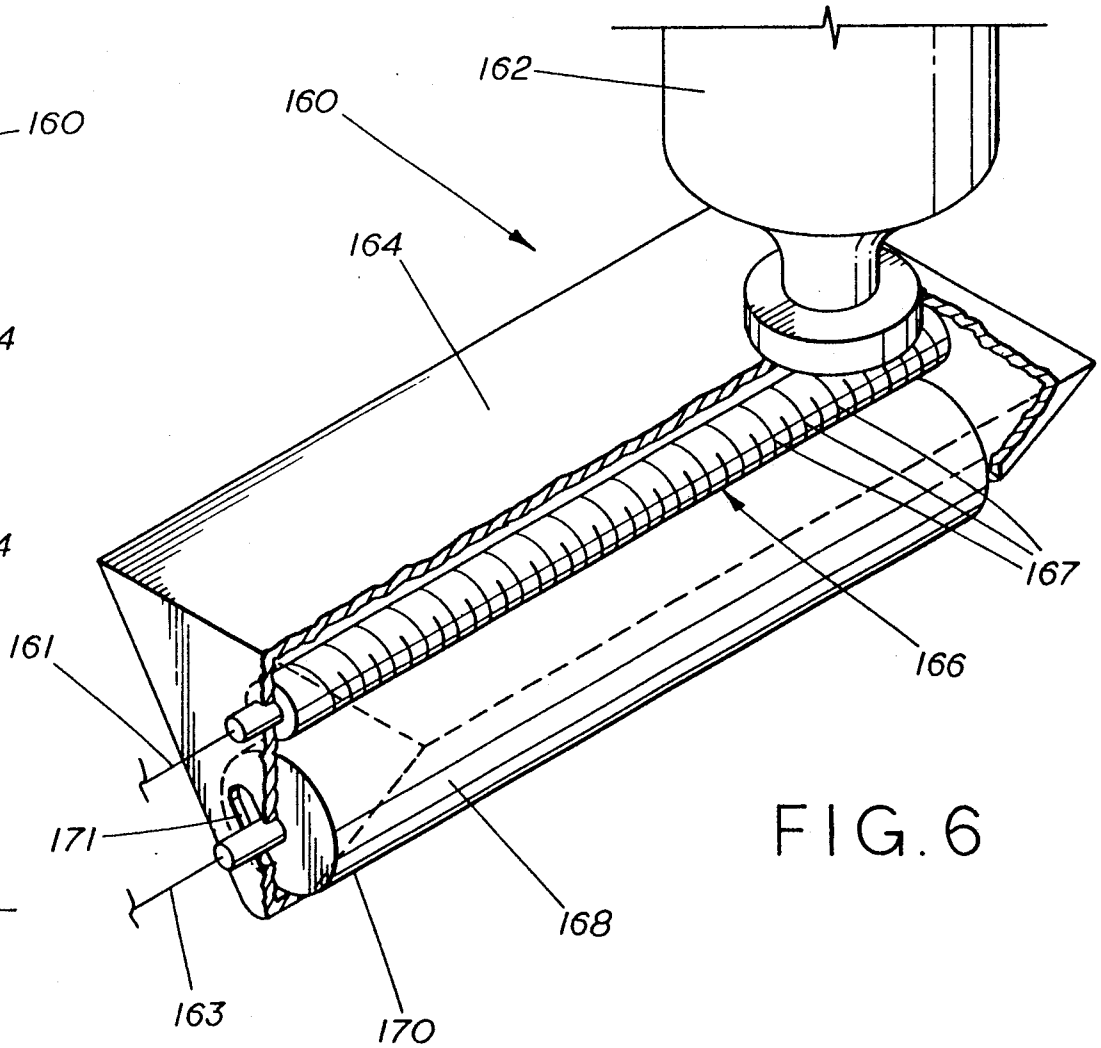
FIG. 6, is a perspective view, partially in section, of an ink cartridge in accord with the present invention.
Figure 5:
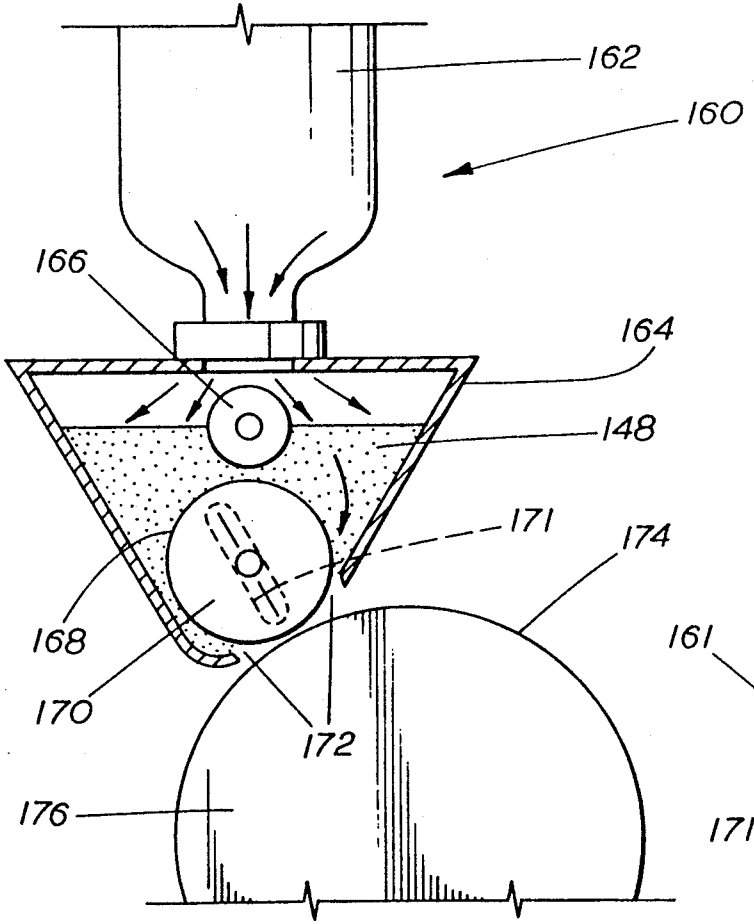
FIG. 5 is an elevational view, partially in section, showing an ink cartridge feed to an inking cylinder in accord with the present invention.

FIG. 5 and FIG. 6 show internal components of preferred embodiment ink cartridge 160 and provide an overview of transfer of ink particles 148 from ink cartridge 160 to inking cylinder 176. Dry ink particles 148 flow from refill bottle 162 by gravity into ink cartridge housing 164. The direction of ink flow is shown generally by arrows. Dry ink agitator roller 166 spreads ink particles 148 throughout the interior of ink cartridge housing 164. For this purpose, preferred embodiment dry ink agitator roller 166 includes spiralling grooves 167 which spread dry ink particles 148 in a direction generally away from refill bottle 162. In a preferred embodiment, dry ink agitator roller 166 does not have a voltage impressed thereon but wire 161 is provided so a voltage could be applied if desirable for regulating ink flow. Surface 168 of dry ink cartridge roller 170 has a voltage impressed thereon which attracts dry ink particles 148. The number of ink particles 148 attracted to dry ink cartridge roller 170 is adjustable by this voltage although, in a preferred embodiment, this voltage is normally kept constant at approximately 50 volts via wire 163. The number of ink particles on surface 168 of dry ink cartridge roller 170 is also physically adjustable since the dry ink cartridge roller is laterally movable in slot 171 in a direction transverse to that portion of surface 174 of inking cylinder 176 to which the ink is applied, thereby permitting the reliable control of the effective size of opening 172. Inking particles 148 will flow from rotating dry ink cartridge roller 170 to inking cylinder 176 at a flow rate related to the voltage difference between surface 168 and 174. Inking particles 148 may be comprised of a number of different compounds, some of which are already well known and used in various electrostatic and electronic printers. Ink particles may be comprised of ink pigments, dry varnish, resins, plastics, as well as various epoxies. An epoxy may be included in the varnish carrier which would react to a second epoxy in the dry ink to speed drying by catalytic reaction so that catalysts in general may be used. In a preferred embodiment, ink color pigments, dried varnish, and an epoxy catalyst are used. Extra enhancers of various types known to those skilled in the art may be added to create gloss, semigloss, or dull finish to the final image. In a preferred embodiment, inking particles 148 are dry in the sense that they are in solid rather than liquid form.

Figure 4:
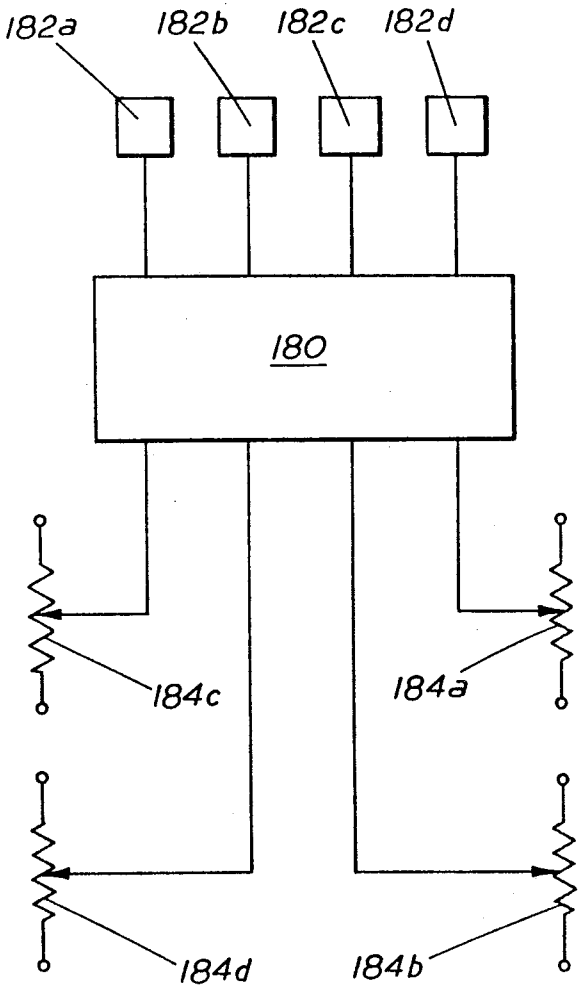
FIG. 4 is a schematic of a computer controlled intensity monitoring circuit in accord with the present invention.

FIG. 4 is a circuit diagram which shows an optional computer controlled color intensity monitor which is adaptable to a four color printer or perhaps a single color printer with four color applicators in accord with the present invention. Photo-optical sensors 182 *a–d* can be used to monitor the output from each color printing unit in a four color printer such as color printing units 80, 90, 100, and 110 shown in FIG. 2. The outputs from photo-optical sensors 182 *a–d* may be interfaced to computer 180 in a manner well known in the art and compared to a desired or preset level. Any variations can be offset using computer outputs to control variable controls 184*a–d* which may be used to adjust voltage on respective inking cylinders controlling color intensity to insure a substantially constant color density throughout even large printing jobs. Variable controls 184 *a–d* may be used with wires such as 149, 147, or 155 to supply a variable voltage to respective related surfaces. In a preferred embodiment, a variable voltage is supplied only to the inking cylinder such as inking cylinder 149. A power supply (not shown) may also connect to variable controls 184 *a–d*. Controls 184*a–d* are shown only to represent symbolically voltage controls and it is well known in the art that many methods may be used to supply varying, constant, or selected constant voltages to an electrode either by computer or manually.

The foregoing description of the invention has been directed in primary part to particular, preferred embodiments in accordance with the requirements of the patent statutes and for purposes of illustration. It will be apparent to those skilled in the art that many modifications and changes in the specifically described preferred embodiments may be made without departing from the scope and spirit of the invention. Therefore the invention is not restricted to the preferred embodiment illustrated but covers all modifications which may fall within the spirit of the invention.

I claim:

1. A process for printing an image onto a target element using a printing plate, comprising the following steps:

applying an attractant material to image areas of said printing plate, said image areas forming the image to be printed;

repelling said attractant material from non-image areas of said printing plate with an oleophobic substance;

transferring said attractant material between said printing plate and said target element such that said transferred attractant material substantially retains the shape of said image; and contacting ink with said attractant material on said target element such that said ink conforms to the shape of said image on said target element.

2. A process for printing an image onto a target element using a printing plate, comprising the following steps:

applying an attractant material to image areas of said printing plate, said image areas forming the image to be printed;

transferring said attractant material onto a blanket cylinder from said printing plate;

transferring said attractant material from said blanket cylinder onto said target element, said attractant material substantially retaining the shape of said image;

moving said target element containing said attractant material between said inking cylinder and an attraction roller;

applying a voltage to said attraction roller for attracting said ink to said attractant material;

applying a water solution to non-image areas of said printing plate, said water solution preventing said attractant material from sticking to said non-image areas of said printing plate; and contacting ink with said attractant material on said target element such that said ink conforms to the shape of said image on said target element.

3. A process for printing an image onto a target element using a printing plate, comprising the following steps:

forming a plate cylinder having a surface including said printing plate;

applying varnish onto said surface of said plate cylinder with a varnish roller to image areas of said printing plate;

applying water to said plate cylinder with a water roller;

transferring said attractant material between said printing plate and said target element such that said transferred attractant material substantially retains the shape of said image; and contacting ink with said attractant material on said target element such that said ink conforms to the shape of said image on said target element.

4. The process of claim 3, wherein said applying said varnish comprises:

applying only enough varnish to allow said image to be completely transferred to said target element such that said varnish is applied in a relatively thin layer.

5. A process for printing an image onto paper, comprising the following steps:

forming a plate cylinder with a surface containing non-image areas and image areas of a selected image;

applying a water solution to said plate cylinder non-image areas;

applying an attractant material to said image areas on said plate cylinder;

transferring said attractant material or said image areas of said plate cylinder to a blanket cylinder so that said attractant material remains substantially in the shape of said image areas;

transferring said attractant material from said blanket cylinder to a target element so that said attractant material on said target element remains substantially in the shape of said image areas;

coating an inking cylinder with ink; and contacting said attractant material on said target element with said ink from said inking cylinder to form said image in ink on said target element.

6. A printing apparatus for printing onto a target element using an attractant material and dry ink, comprising:

a plate cylinder containing an image formed in image areas and non-image areas, said image areas attracting said attractant material prior to a transfer of said attractant material to said target element;

means for applying said attractant material onto said plate cylinder;

means for preventing said attractant material from accumulating on said non-image areas of said plate cylinder including water rollers for applying a water solution to said plate cylinder; and an inking applicator for applying said dry ink to said attractant material on said target element.

7. A printing apparatus for printing onto a target element using an attractant material and dry ink, comprising:

a plate cylinder containing an image formed in image areas and non-image areas, said image areas attracting said attractant material prior to a transfer of said attractant material to said target element;

means for applying said attractant material onto said plate cylinder;

repelling means for preventing said attractant material from accumulating on said non-image areas of said plate cylinder, said repelling means including a hydrophilic substance applied to said non-image areas, said hydrophilic substance being functional for repelling said attractant material which is comprised of a hydrophobic substance; and an inking applicator for applying said dry ink to said attractant material on said target element.

8. The apparatus of claim 7, further comprising:

an inking cylinder with an insulated surface for said inking applicator, said insulated surface of said inking cylinder having a first voltage impressed thereon for attracting said dry ink; and an ink cartridge for said inking applicator, said ink cartridge enclosing said dry ink prior to its transfer to said inking cylinder, said ink cartridge being disposed adjacent said inking cylinder;

an ink cartridge roller within said ink cartridge, said ink cartridge roller having a second voltage impressed thereon, said cartridge roller holding said dry ink on its surface prior to said dry ink flowing to said inking cylinder; and an attraction roller for said inking applicator disposed adjacent said inking cylinder, said attraction roller having a surface onto which a third voltage is impressed, said attraction roller third voltage attracting said dry ink onto said attractant material when said target element is between said attraction roller and said inking cylinder.

9. The apparatus of claim 7, further comprising:

an ink cartridge for said inking applicator, said ink cartridge having an elongate opening therein adjacent said inking cylinder, said elongate opening being substantially parallel to said inking cylinder so as to be equidistant from said inking cylinder along the length of said elongate opening;

an ink cartridge roller being disposed partially within said elongate opening, said ink cartridge roller being laterally movable so as to variably limit the magnitude of flow of ink through said elongate opening.

10. The apparatus of claim 7, further comprising:

a photosensor for said inking applicator responsive to the intensity of light reflected from said attractant material image containing said dry ink.

* * * * *